US005359752A

United States Patent [19]

Domenig

[11] Patent Number: 5,359,752

[45] Date of Patent: Nov. 1, 1994

[54] LATERALLY ADJUSTABLE MOUNTING BRACKET FOR USE ON A DRAWER AND WITH A TONGUELESS DRAWER GUIDE IN CONNECTION WITH A DESK OR CABINET

[76] Inventor: Georg Domenig, 1205 Bayhill Ct., Kernersville, N.C. 27284

[21] Appl. No.: 60,838

[22] Filed: May 14, 1993

Related U.S. Application Data

[63] Continuation-in-part of Ser. No. 929,754, Aug. 12, 1992, abandoned.

[51] Int. Cl.[5] ..... E05D 15/00

[52] U.S. Cl. ..... 16/94 R; 16/383; 312/330.1; 312/334.5

[58] Field of Search ..... 312/330.1, 334.5, 334.7, 312/334.27, 334.14; 16/94

[56] References Cited

U.S. PATENT DOCUMENTS

| | | | |
|---|---|---|---|
| 3,680,177 | 8/1972 | Ginsberg | 312/330.1 |
| 4,188,685 | 2/1980 | Rock et al. | 16/383 |
| 4,244,546 | 1/1981 | Mertes et al. | 312/334.27 |
| 4,501,453 | 2/1985 | Gutner et al. | 312/330.1 |
| 4,574,425 | 3/1986 | Sugiura | 16/383 |
| 4,690,469 | 9/1987 | Grass | 312/330.1 |
| 5,039,181 | 8/1991 | Lautenschlager | 312/334.7 |

FOREIGN PATENT DOCUMENTS

| | | | |
|---|---|---|---|
| 583674 | 12/1946 | United Kingdom | 16/94 R |

*Primary Examiner*—P. Austin Bradley
*Assistant Examiner*—Chuck Y. Mah

[57] ABSTRACT

A laterally adjustable mounting bracket for use on a desk or cabinet drawer maintained by a supporting surface and with a tongueless drawer guide having a base plate, a moveable drawer guide plate cooperatively receiving a tongueless drawer guide, and means for adjustably securing the drawer guide plate to the base plate. The adjustable securing means includes base plate spring members having a plurality of serrations, guide plate spring engaging members having a plurality of serrations cooperatively engaging the serrations of the base plate spring members to enable preselective lateral adjustment of the drawer, drawer guide and drawer guide plate with respect to the desk or cabinet housing the drawer. The drawer guide plate has a resilient stop and the base plate has an elongated slot and connecting ramp cooperatively receiving and engaging the stop to limit the preselected adjustment of the drawer, drawer guide and drawer guide plate with respect to the desk or cabinet. The base plate has top and bottom flanges cooperatively receiving the drawer guide plate for preselected adjustment therebetween.

3 Claims, 1 Drawing Sheet

LATERALLY ADJUSTABLE MOUNTING BRACKET FOR USE ON A DRAWER AND WITH A TONGUELESS DRAWER GUIDE IN CONNECTION WITH A DESK OR CABINET

This is a continuation in part of Serial No. 07/929,754 filed August 12, 1992, now abandoned.

BACKGROUND OF THE INVENTION

1. Field of the Invention.

The present invention relates to adjustable mounting brackets and more particularly to a new and improved adjustable mounting bracket for use on a desk or cabinet drawer and with a tongueless drawer guide. A base plate and a moveable drawer guide plate cooperatively receive a tongueless drawer guide to enable the lateral adjustment of the drawer with respect to the desk or cabinet.

2. Description of the Prior Art

Various types of adjustable mounting brackets are used to provide some lateral adjustment for drawers housed by desk or cabinets to enable proper alignment of the drawers within the housing and the smooth and efficient operation thereof thereafter. Such devices are adequate to a certain degree, however they are for the most part not precisely designed and manufactured so that slippage and looseness is usually inherent from its first installation and increasingly develops within a short period of time. For the most part, these prior art devices are simply constructed without any precise adjustment means, wear quickly, and thus provide inadequate functional assistance soon after installation.

In order to overcome the deficiencies of the prior art, it has been found necessary to increase the design and engineering skills applied to the development of such brackets to the extent that more precisely adjustable elements and components are included thereby providing a more finite adjustment and a more secure arrangement which will endure longer operational periods.

Since the prior art is comprised mostly of simply designed and manufactured adjustable brackets like those previously described, it can be appreciated that there is a continuing need for improvements to such devices. The present invention addresses the need for such improvements.

SUMMARY OF THE INVENTION

The general purpose of the present invention, which will be described subsequently in greater detail, is to provide a new and improved adjustable mounting bracket which has all of the advantages of prior art brackets and none of the disadvantages. To attain this purpose, a representative embodiment of the present invention is illustrated in the drawings and makes use of a base plate, a moveable drawer guide plate cooperatively receiving a tongueless drawer guide and cooperatively associated with the base plate. Adjustable means secure the drawer guide plate to the base plate in a manner that enables selective lateral adjustment to be made thereafter. A plurality of base plate spring members having serrations cooperate with guide plate spring engaging members having cooperatively mating serrations engaging the serrations of the base plate spring members to enable preselective lateral adjustment of the drawer and the carried drawer and guide and drawer guide plate with respect to the desk or cabinet. The drawer guide plate has a resilient stop, and the base plate has an elongated slot and connecting ramp cooperatively receiving and engaging the stop to limit the preselected adjustment of the drawer, drawer guide and drawer guide plate. The base plate has top and bottom flanges cooperatively receiving the drawer guide plate for preselected adjustment therebetween. The base plate is secured to the desk or cabinet in a conventional fashion.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. It is to be understood that the phraseology and terminology employed herein are for the purpose of description and should not be regarded as limiting. As such, those skilled in the art will appreciate the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. The abstract is neither intended to define the invention of the application, which is measured by the claims, nor is it intended to be limiting as to the scope of the invention in any way.

It is therefore an object of the present invention to provide a new and improved adjustable mounting bracket to enable precise lateral adjustment between a drawer carrying the bracket and associated hardware and the desk or cabinet in which the drawer resides.

It is another object of the present invention to provide a new and improved adjustable mounting bracket that is more precisely designed and engineered than prior art devices and that will function with greater precision and longevity than prior art devices. It is yet still another further object of the present invention to provide a new and improved adjustable mounting bracket that will operate with more efficiency, can be adjusted with greater specificity, and can be produced more economically than prior art devices.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference is made to the accompanying drawings and descriptive matter in which like characters of reference designate like parts throughout the several views.

BRIEF DESCRIPTION OF THE DRAWINGS

The invention will be better understood and objects other than those set forth above will be become apparent when consideration is given to the following detailed description. Such description makes reference to the annexed drawings wherein.

DESCRIPTION OF THE PREFERRED EMBODIMENT

Figure 1:
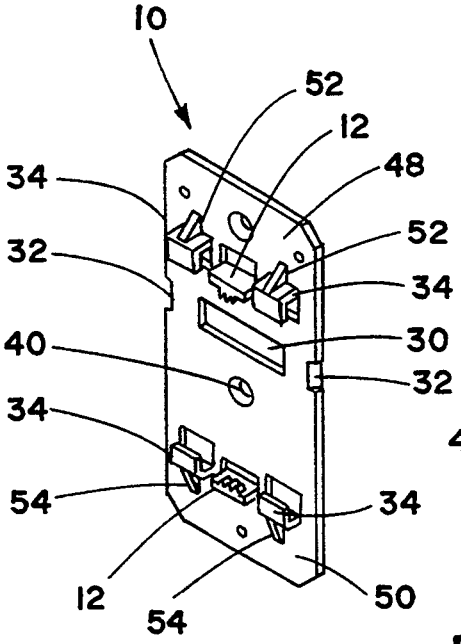
FIG. 1 is a perspective view of the bracket base plate comprising a part of the present invention.
Figure 2:
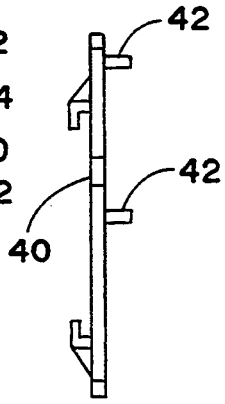
FIG. 2 is a side elevational view of the base plate shown in FIG. 1.
Figure 9:
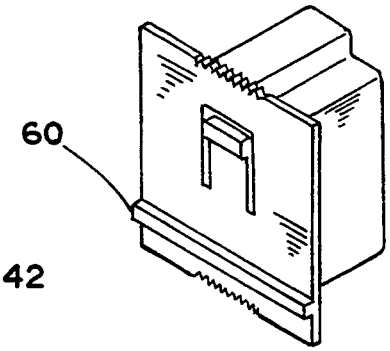
FIG. 9 is a perspective and fragmentary view of another embodiment of the drawer guide plate to be utilized with the bracket base plate shown in FIGS. 7 and 8.
Figure 3:
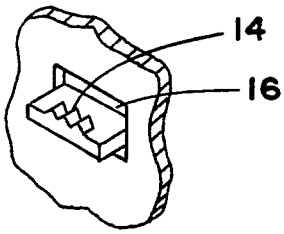
FIG. 3 is an enlarged, fragmentary and perspective view of a base plate spring member carried by the base plate shown in FIGS. 1 and 2.
Figure 5:
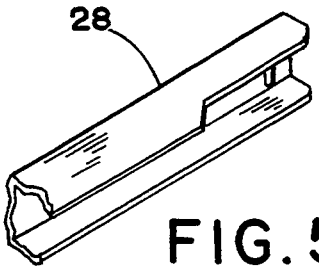
FIG. 5 is a diminished, perspective and fragmentary view of a guide rail cooperating with the present invention to provide lateral adjustment of a desk or cabinet carry drawer.
Figure 6:
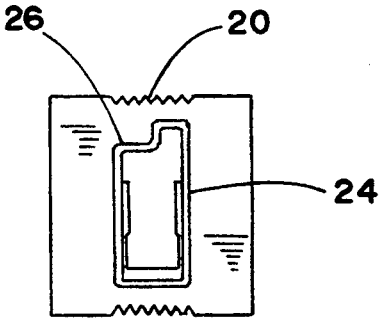
FIG. 6 is an end elevational view of the moveable drawer guide plate shown in FIG. 4.

With reference now to the drawings and in particular to FIG. 1, a base plate shown generally as 10 has a plurality of spring members 12 each having a plurality of serrations 14 (FIG. 3), the spring being mounted in an opening 16 formed in the body of base plate 10. While more than 2spring members may be used, an even number is more efficient in use since all base plates may be made to a standard configuration, and no different configuration is needed as would be the case if using an odd number of spring members.

Figure 4:
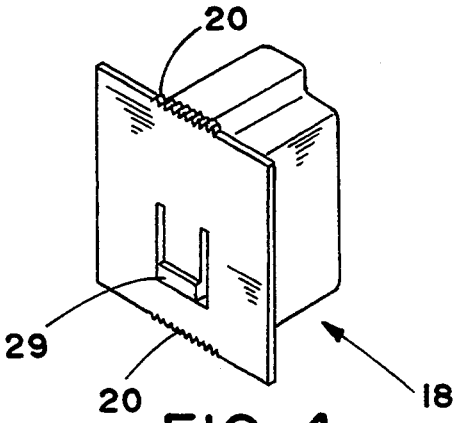
FIG. 4 is a perspective and fragmentary view of the drawer guide plate comprising a component of the present invention.

A moveable drawer guide plate shown generally as 18 (FIG. 4) has a plurality of guide plate spring engaging surfaces 20 having a plurality of serrations 22 that cooperatively engage the serrations 14 of the base plate spring members 12 to enable preselective lateral adjustment of the drawer with respect to the desk or cabinet.

The drawer guide plate 18 has a drawer guide receiving portion 24 configured at its stepped top 26 to exert a continuous force on the received drawer guide 28. The drawer guide plate 18 has a resilient stop 29, and the base plate 10 has an elongated slot 30 and a connecting ramp 32 cooperatively receiving and engaging the resilient stop 28 to limit the preselected adjustment of the drawer with respect to the desk or cabinet.

Base plate 10 has top and bottom flanges 34 that cooperatively receive the drawer guide plate 18 for preselected adjustment therebetween. Lateral adjustment is accomplished by forcibly moving the drawer guide with respect to its connected drawer guide plate causing spring members 12 to resiliently give way to the pressure and slide notch by notch over the serrations 20 of the guide plate 18

While the configuration of the assembly as a whole will normally hold a drawer in the selected lateral position, an additional securing element can be provided in the form of a screw inserted in a hole in flange 40 of drawer guide plate 18. Thus the screw can be tightened to prevent any inadvertent movement of the drawer with respect to the desk or cabinet.

The base plate is connected to the housing structure through a plurality of screw receiving channels 42. These are configured to expand when a screw is inserted to enable a stronger connection to the supporting wall as the screw passes through the protrusion and enters the wooden support surface.

Figure 7:
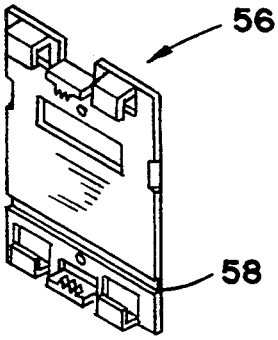
FIG. 7 is a perspective view of another embodiment of the bracket base plate comprising a part of the present invention.
Figure 8:
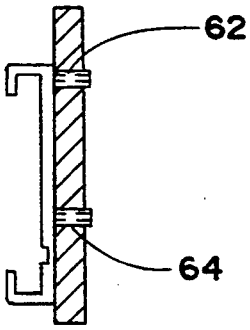
FIG. 8 is a side elevational view of the base plate shown in FIG. 7.

Another preferred embodiment of the present invention involves modifying the base plate to shorten the upper and lower tabs 48,50 and eliminate the triangular upper and lower supports 52,54 thus resulting in the shorter base plate shown generally as 56 in FIGS. 7 and 8.

A channel 58 is formed in the face of the base plate 56, and a support ridge 60 is provided on the guideplate to be cooperatively received by channel 58 when the plates are joined together.

An upper pin 62 is slotted and has an enlarged distal end portion and a body portion of a predetermined length which is equal to the thickness of the rear supporting wall to enable insertion and engagement of the back side of the rear supporting wall by the enlarged distal end portion. A lower pin 64 is solid. Thus no screws are necessary for attachment of base plate 10 to the rear supporting wall in this embodiment.

With respect to the description set forth above, the optimum dimensional relationship for the pans of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is intended not to limit the invention to the exact construction and operation shown and described. All suitable modifications and equivalents that fall within the scope of the appended claims are deemed within the present inventive concept.

What is claimed is:

1. A laterally adjustable mounting bracket for use with a drawer maintained by a supporting surface and with a tongueless drawer guide, the bracket comprising: a base plate releasably secured to the supporting surface; a movable drawer guide plate cooperatively receiving a tongueless drawer guide and cooperatively associated with the base plate; and means associated with base plate and guide plate adjustably securing the drawer guide plate to the base plate, the adjustably securing means including base plate spring members having a plurality of serrations, guide plate engaging members having a plurality of serrations cooperatively engaging the serrations of the base plate spring members to enable preselective lateral adjustment of the drawer and the carried drawer guide and drawer guide plate, the drawer guide plate having a resilient stop and the base plate having an elongated slot and connecting ramp cooperatively receiving and engaging the resilient stop to limit the preselected adjustment of the drawer, drawer guide, and drawer guide plate wherein the guide plate and the base plate means includes a support ridge on one of the plates and a channel on the other of the plates cooperatively receiving the support ridge.

2. A laterally adjusted mounting bracket for use with a drawer maintained by a supporting surface and with a tongueless drawer guide, the bracket comprising: a base plate releasably secured to the supporting surface; a movable drawer guide plate cooperatively receiving a tongueless drawer guide and cooperatively associated with the base plate; and means associated with base plate and guide plate adjustably securing the drawer guide plate to the base plate, the adjustably securing means including base plate spring members having a plurality of serrations, guide plate engaging members having a plurality of serrations cooperatively engaging the serrations of the base plate spring members to enable preselective lateral adjustment of the drawer and the carried drawer guide and drawer guide plate, the drawer guide plate having a resilient stop and the base plate having an elongated slot and connecting ramp cooperatively receiving and engaging the resilient stop to limit the preselected adjustment of the drawer, drawer guide, and drawer guide plate wherein the drawer guide plate has a drawer guide receiving portion configured to exert a continuous force on the received drawer guide, wherein the base plate has top and bottom flanges cooperatively receiving the drawer guide plate for preselected adjustment therebetween, and wherein the guide plate and the base plate means includes a support ridge on one of the plates and a channel on the other of the plates cooperatively receiving the support ridge.

3. The bracket as claimed in claim 2 wherein the base plate is secured to the supporting surface by slotted pins having a body portion and an enlarged distal end portion extending through the supporting surface.

* * * * *